US011174709B2

(12) United States Patent
Steele et al.

(10) Patent No.: US 11,174,709 B2
(45) Date of Patent: Nov. 16, 2021

(54) MECHANICAL BARRIERS FOR DOWNHOLE DEGRADATION AND DEBRIS CONTROL

(71) Applicant: Halliburton Energy Services, Inc., Houston, TX (US)

(72) Inventors: David Joe Steele, Arlington, TX (US); Aihua Liang, Plano, TX (US); Srinivasa Prasanna Vemuri, Frisco, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 16/088,507

(22) PCT Filed: Dec. 8, 2017

(86) PCT No.: PCT/US2017/065354
§ 371 (c)(1),
(2) Date: Sep. 26, 2018

(87) PCT Pub. No.: WO2019/112613
PCT Pub. Date: Jun. 13, 2019

(65) Prior Publication Data

US 2021/0140278 A1 May 13, 2021

(51) Int. Cl.
*E21B 41/02* (2006.01)
*E21B 23/02* (2006.01)
*E21B 33/12* (2006.01)

(52) U.S. Cl.
CPC ..... *E21B 41/02* (2013.01); *E21B 23/02* (2013.01); *E21B 33/1204* (2013.01)

(58) Field of Classification Search
CPC ..... E21B 41/00; E21B 41/02; E21B 43/26; E21B 23/02; E21B 33/1204
See application file for complete search history.

(56) References Cited

U.S. PATENT DOCUMENTS 2,845,940 A * 8/1958 Garrett ..... E21B 43/123 137/155
5,911,285 A 6/1999 Stewart et al.
(Continued)

FOREIGN PATENT DOCUMENTS

EP 0774040 B1 3/2000
RU 2352756 C1 4/2009
(Continued)

OTHER PUBLICATIONS

International Search Report and the Written Opinion of the International Search Authority, or the Declaration, dated Sep. 6, 2018, PCT/US2017/065354, 14 pages, ISA/KR.
(Continued)

*Primary Examiner* — Nicole Coy
*Assistant Examiner* — Yanick A Akaragwe

(57) ABSTRACT

A system and method to protect downhole tools and equipment used in transporting fluids with erosional and/or corrosive characteristics is disclosed according to one or more embodiments. The protection assembly engages with a latch coupling or other surface in need of protection to form a barrier between the latch coupling surface and any erosional or corrosive fluids. The protection assembly comprises a barrier sleeve portion and a support sleeve portion disposed in the barrier sleeve. The support sleeve is moveable between a first and second position within the barrier sleeve. In a first position of the support sleeve, collet fingers in the barrier sleeve may flex to allow movement through the latch coupling while in a second position of the support sleeve, the collet fingers may not flex and the barrier sleeve is engaged and protecting the latch coupling.

19 Claims, 15 Drawing Sheets

(56) References Cited

U.S. PATENT DOCUMENTS

| | | | | |
|---|---|---|---|---|
| 7,419,003 | B2 | 9/2008 | Russell | |
| 7,968,184 | B2 | 6/2011 | Humphreys et al. | |
| 8,708,051 | B2 | 4/2014 | McDowell et al. | |
| 9,850,719 | B1 * | 12/2017 | Ferrier | E21B 19/004 |
| 10,267,099 | B2 * | 4/2019 | Mailand | E21B 34/06 |
| 2005/0269076 | A1 | 12/2005 | Russell | |
| 2006/0272807 | A1 | 12/2006 | Adam et al. | |
| 2008/0296029 | A1 | 12/2008 | Ortiz | |
| 2008/0314588 | A1 | 12/2008 | Langlais et al. | |
| 2009/0050314 | A1 | 2/2009 | Holmes | |
| 2010/0282475 | A1 | 11/2010 | Darnell et al. | |
| 2011/0139438 | A1 | 6/2011 | Nold et al. | |
| 2013/0228327 | A1 | 9/2013 | White et al. | |
| 2014/0216713 | A1 | 8/2014 | Schultz et al. | |
| 2014/0224342 | A1 | 8/2014 | Bao et al. | |
| 2014/0262339 | A1 | 9/2014 | Nero et al. | |
| 2015/0240627 | A1 | 8/2015 | Gao et al. | |
| 2015/0330185 | A1 * | 11/2015 | Hughes | E21B 34/103 166/318 |
| 2016/0053562 | A1 | 2/2016 | Frosell et al. | |
| 2016/0362962 | A1 * | 12/2016 | Gonzalez | E21B 34/063 |
| 2017/0254157 | A1 | 9/2017 | Mailand | |

FOREIGN PATENT DOCUMENTS

| | | | |
|---|---|---|---|
| RU | 2527043 | C2 | 8/2014 |
| RU | 2531076 | C1 | 10/2014 |
| WO | WO 1999-002818 | A1 | 1/1999 |
| WO | WO 2004-099560 | A1 | 11/2004 |
| WO | WO 2012-081986 | A1 | 6/2012 |
| WO | WO 2017-058171 | A1 | 4/2017 |

OTHER PUBLICATIONS

Office Action for Russian Patent Application No. 2020112951, prepared by the Russian Federal Institute of Industrial Property, dated Dec. 18, 2020, (5 pgs.).

Search Report for Russian Patent Application No. 2020112951, prepared by the Russian Federal Institute of Industrial Property, dated Dec. 18, 2020, (2 pgs.).

English Translation of Office Action and Search Report for Russian Patent Application No. 2020112951, prepared by the Russian Federal Institute of Industrial Property, dated Dec. 18, 2020, (6 pgs.).

Coronado et al., "New Inflow Control Device Reduces Fluid Viscosity Sensitivity and Maintains Erosion Resistance", www.onepetro.org, 2009, pp. 1-14.

* cited by examiner

MECHANICAL BARRIERS FOR DOWNHOLE DEGRADATION AND DEBRIS CONTROL

PRIORITY

The present application is a U.S. National Stage patent application of International Patent Application No. PCT/US2017/065354, filed on Dec. 8, 2017, the benefit of which is claimed and the disclosure of which is incorporated herein by reference in its entirety.

TECHNICAL FIELD

The present disclosure generally relates to oilfield equipment and, in particular, to downhole tools, drilling and related systems and techniques for drilling, completing, servicing, and evaluating wellbores in the earth. More particularly still, the present disclosure relates to systems and methods for protecting downhole tools and equipment used in transporting fluids with erosional and/or corrosive characteristics.

BACKGROUND

The present disclosure relates generally to operations performed and equipment utilized in conjunction with subterranean wells and, in an embodiment described herein, more particularly provides systems and methods for protecting downhole tools and equipment by preventing or reducing degradation of the downhole tools and equipment from fluids with erosional and/or corrosive properties systems such as slurries or high velocity flows used in fracturing.

Multilateral wells typically have one or more secondary wellbores, often referred to as branch or lateral wellbores, extending from a main or parent wellbore. The intersection between a primary wellbore is known as a "wellbore junction." After drilling the various sections of a subterranean wellbore that traverses a formation, individual lengths of relatively large diameter metal tubulars are typically secured together to form a casing string that is positioned within the wellbore. This casing string increases the integrity of the wellbore and provides a path for producing fluids from the producing intervals to the surface. Conventionally, the casing string is cemented within the wellbore by pumping a cement slurry through the casing and into the annulus between the casing and the formation. To produce fluids into the casing string, hydraulic openings or perforations must be made through the casing string, the cement sheath, and a short distance into the formation.

Typically, these perforations are created by a perforator connected along a tool string that is lowered into the cased wellbore by a tubing string, wireline, slickline, coiled tubing, or other conveyance. Once the perforator is properly oriented and positioned in the wellbore adjacent the formation to be perforated, the perforator creates perforations through the casing and cement sheath into the formation.

Hydrocarbon-producing wells may be stimulated by hydraulic fracturing operations. In hydraulic fracturing operations, a liquid slurry or viscous fracturing fluid, which also functions as a carrier fluid, is pumped into a producing zone at a rate and pressure to break down or erode the subterranean formation and form at least one fracture in the zone. Particulate solids, such as sand, suspended in a portion of the fracturing fluid are then deposited in the fractures. These particulate solids or proppant particulates help prevent the fractures from fully closing and allow conductive channels to form through which produced hydrocarbons can flow. The proppant particulates used to prevent fractures from fully closing may be naturally-occurring, man-made or specially engineered, such as sand grains, bauxite, ceramic spheres, or aluminum oxide pellets, which are deposited into fractures using traditional high proppant loading techniques. However, the proppant particulates, which are typically abrasive, may erode and/or corrode the downhole tools and equipment. For example, portions of an orienting latch profile on a latch coupling may be eroded and/or corroded by proppant particulates when pumped into and flushed back out the well, which can prevent tools from engaging the eroded profile.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements. Embodiments are described in detail hereinafter with reference to the accompanying figures, in which.

DETAILED DESCRIPTION OF THE DISCLOSURE

Figure 1:
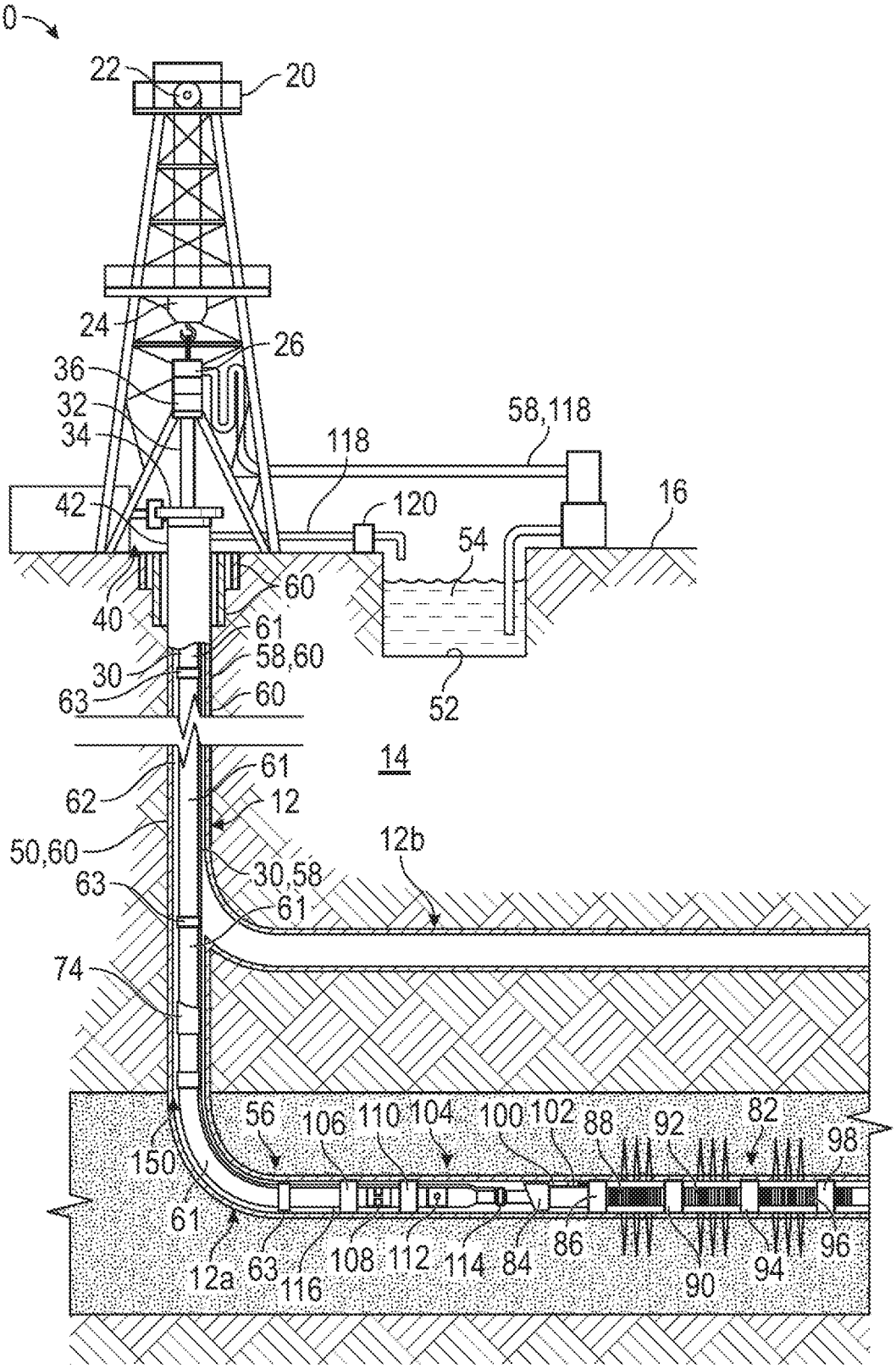
FIG. 1 is an elevation view in partial cross section of a land-based well system with a protection system to mitigate degradation of downhole tools and equipment according to an embodiment.

The disclosure may repeat reference numerals and/or letters in the various examples or Figures. This repetition is for the purpose of simplicity and clarity and does not in itself dictate a relationship between the various embodiments and/or configurations discussed. Further, spatially relative terms, such as beneath, below, lower, above, upper, uphole, downhole, upstream, downstream, and the like, may be used herein for ease of description to describe one element or feature's relationship to another element(s) or feature(s) as illustrated, the upward direction being toward the top of the corresponding figure and the downward direction being toward the bottom of the corresponding figure, the uphole direction being toward the surface of the wellbore, the downhole direction being toward the toe of the wellbore. Unless otherwise stated, the spatially relative terms are intended to encompass different orientations of the apparatus in use or operation in addition to the orientation depicted in the Figures. For example, if an apparatus in the Figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Moreover, even though a figure may depict a horizontal wellbore or a vertical wellbore, unless indicated otherwise, it should be understood by those skilled in the art that the apparatus according to the present disclosure is equally well-suited for use in wellbores having other orientations including slanted wellbores, multilateral wellbores, or the like. Likewise, unless otherwise noted, even though a figure may depict an offshore operation, it should be understood by those skilled in the art that the apparatus according to the present disclosure is equally well-suited for use in onshore operations and vice-versa.

Figure 2:
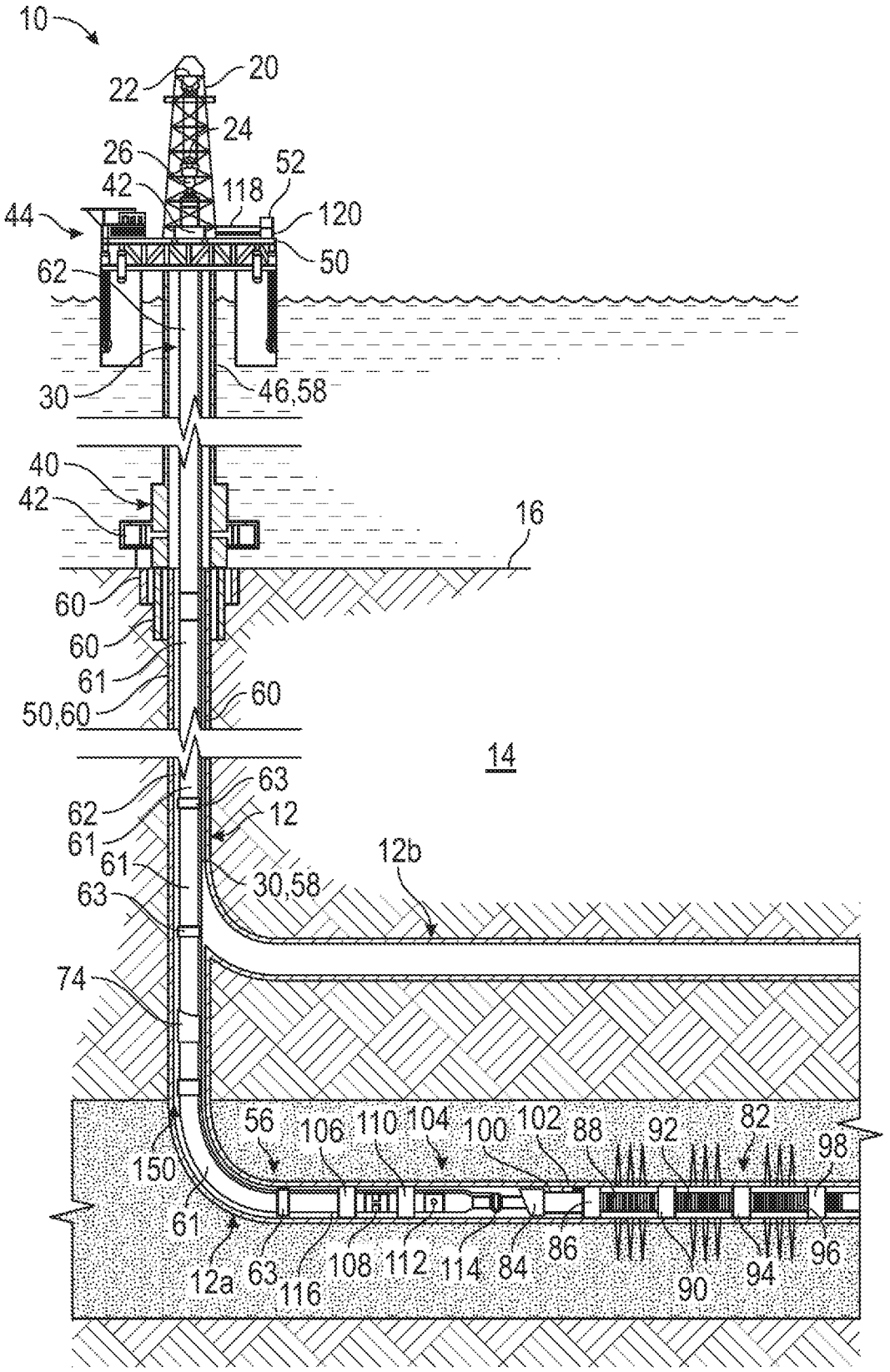
FIG. 2 is an elevation view in partial cross section of a marine-based well system with a protection system to mitigate degradation of downhole tools and equipment according to an embodiment.

Turning to FIGS. 1 and 2, shown is an elevation view in partial cross-section of a wellbore drilling and production system 10 utilized to produce hydrocarbons from wellbore 12 extending through various earth strata in an oil and gas formation 14 located below the earth's surface 16. Wellbore 12 may be formed of a single or multiple bores 12*a*, 12*b*, . . . 12*n* (illustrated in FIG. 2), extending into the formation 14, and disposed in any orientation, such as the horizontal wellbore 12*b* illustrated in FIG. 2.

Drilling and production system 10 includes a drilling rig or derrick 20. Drilling rig 20 may include a hoisting apparatus 22, a travel block 24, and a swivel 26 for raising and lowering casing, drill pipe, coiled tubing, production tubing, other types of pipe or tubing strings or other types of conveyance vehicles such as wireline, slickline, and the like 30. In FIG. 1, conveyance vehicle 30 is a substantially tubular, axially extending drill string formed of a plurality of drill pipe joints coupled together end-to-end, while in FIG. 2, conveyance vehicle 30 is completion tubing supporting a completion assembly as described below. Drilling rig 20 may include a kelly 32, a rotary table 34, and other equipment associated with rotation and/or translation of tubing string 30 within a wellbore 12. For some applications, drilling rig 20 may also include a top drive unit 36.

Drilling rig 20 may be located proximate to a wellhead 40 as shown in FIG. 1, or spaced apart from wellhead 40, such as in the case of an offshore arrangement as shown in FIG. 2. One or more pressure control devices 42, such as blowout preventers (BOPS) and other equipment associated with drilling or producing a wellbore may also be provided at wellhead 40 or elsewhere in the system 10.

For offshore operations, as shown in FIG. 2, whether drilling or production, drilling rig 20 may be mounted on an oil or gas platform 44, such as the offshore platform as illustrated, semi-submersibles, drill ships, and the like (not shown). Although system 10 of FIG. 2 is illustrated as being a marine-based production system, system 10 of FIG. 2 may be deployed on land. Likewise, although system 10 of FIG. 1 is illustrated as being a land-based drilling system, system 10 of FIG. 1 may be deployed offshore. In any event, for marine-based systems, one or more subsea conduits or risers 46 extend from deck 50 of platform 44 to a subsea wellhead 40. Tubing string 30 extends down from drilling rig 20, through subsea conduit 46 and BOP 42 into wellbore 12.

A working or service fluid source 52, such as a storage tank or vessel, may supply a working fluid 54 pumped to the upper end of tubing string 30 and flow through tubing string 30. Working fluid source 52 may supply any fluid utilized in wellbore operations, including without limitation, drilling fluid, cementious slurry, acidizing fluid, liquid water, steam or some other type of fluid.

Wellbore drilling and production system 10 may generally be characterized as having a pipe system 58. For purposes of this disclosure, pipe system 58 may include casing, risers, tubing, drill strings, completion or production strings, subs, heads or any other pipes, tubes or equipment that couples or attaches to the foregoing, such as string 30, conduit 46, joints 61, collars or latch couplings 63, and latch couplings as well as the wellbore 12 and laterals in which the pipes, casing and strings may be deployed. In this regard, pipe system 58 may include one or more casing strings 60 that may be cemented in wellbore 12, such as the surface, intermediate and production casings 60 shown in FIG. 1. An annulus 62 is formed between the walls of sets of adjacent tubular components, such as concentric casing strings 60 or the exterior of tubing string 30 and the inside wall of wellbore 12 or casing string 60, as the case may be.

Wellbore 12 may include subsurface equipment 56 disposed therein, such as, for example, a completion assembly or some other type of wellbore tool. The working fluid 54 pumped to the upper end of pipe system 58 flows through the longitudinal interior of pipe system 58. The working fluid mixture may then flow upwardly through an annulus 62 to return debris to the surface 16. Fluids, cuttings and other debris returning to surface 16 from wellbore 12 are directed by a flow line 118 to storage tanks 54 and/or processing systems 120, such as shakers, centrifuges and the like.

Subsurface equipment 56 and/or pipe system 58 may include various other tools 74; for example, tool 74 may be a running tool, a retrieving tool, a fracturing tool, or a perforating tool. In an embodiment, tool 74 may be a fluid injection assembly (and individual components) for injection of one or more substances including, but not limited to, water, brine, polymers, bactericides, algaecides, corrosion inhibitors, hydrocarbons, or any combination thereof. Tool 74 may also be a gas injection assembly (and individual components) for injection of one or more substances including, but not limited to, carbon dioxide, carbon monoxide, air, hydrocarbons, nitrogen, inert gases, or any combination thereof. Tool 74 may further be a hydrocarbon recovery system (and individual components) for the recovery of hydrocarbons (e.g., oil, gas, or any combination thereof) and any natural occurring byproduct recovered during the recovery of hydrocarbons (e.g., water, brine, non-hydrocarbon gases (such as nitrogen, carbon dioxide, etc.), traces of minerals and solids such as sulfur, quartz, sand, silt, clay, etc. The hydrocarbon recovery system may be any type of hydrocarbon recovery system known in the art including, but not limited to, gas-lift, artificial lift (e.g., rod & pump, submersible pump, etc.), natural lift (i.e., flowing wells), intelligent wells (wells monitored and/or controlled from the surface, downhole-controlled wells), multilateral completions, combination completions, single string lower-pressure/low-temperature wells (LP/LT), single-string medium-pressure/medium-temperature wells (MP/MT), single-string high-pressure/high-temperature (HP/HT) wells, multi-string LP/LT wells, multi-string MP/MT wells, multi-string HP/HT wells, multiple-zone single-string selective completion, dual-zone completion using parallel tubing strings, bigbore, and monobore completions.

A lower completion assembly 82 is disposed in the casing system 60 and includes various tools such as an orientation and alignment subassembly 84, a packer 86, a sand control screen assembly 88, a packer 90, a sand control screen assembly 92, a packer 94, a sand control screen assembly 96 and a packer 98.

Extending downhole from lower completion assembly 82 is one or more communication cables 100, such as a sensor or electric cable, that passes through packers 86, 90, 94 and is operably associated with one or more electrical devices 102 associated with lower completion assembly 82, such as sensors positioned adjacent casing collars 63, or downhole controllers or actuators used to operate downhole tools or fluid flow control devices. Cable 100 may operate as communication media, to transmit power, or data and the like between lower completion assembly 82 and an upper completion assembly 104.

In this regard, disposed in wellbore 12 at the lower end of tubing string 30 is an upper completion assembly 104 that includes various tools such as a packer 106, an expansion joint 108, a packer 110, a fluid flow control module 112 and an anchor assembly 114. Extending uphole from upper completion assembly 104 are one or more communication cables 116, such as a sensor cable or an electric cable, which extends to the surface 16. Cable 116 may operate as communication media, to transmit power, or data and the like between a surface controller (not shown) and the upper and lower completion assemblies 104, 82, respectively.

Figure 3A:
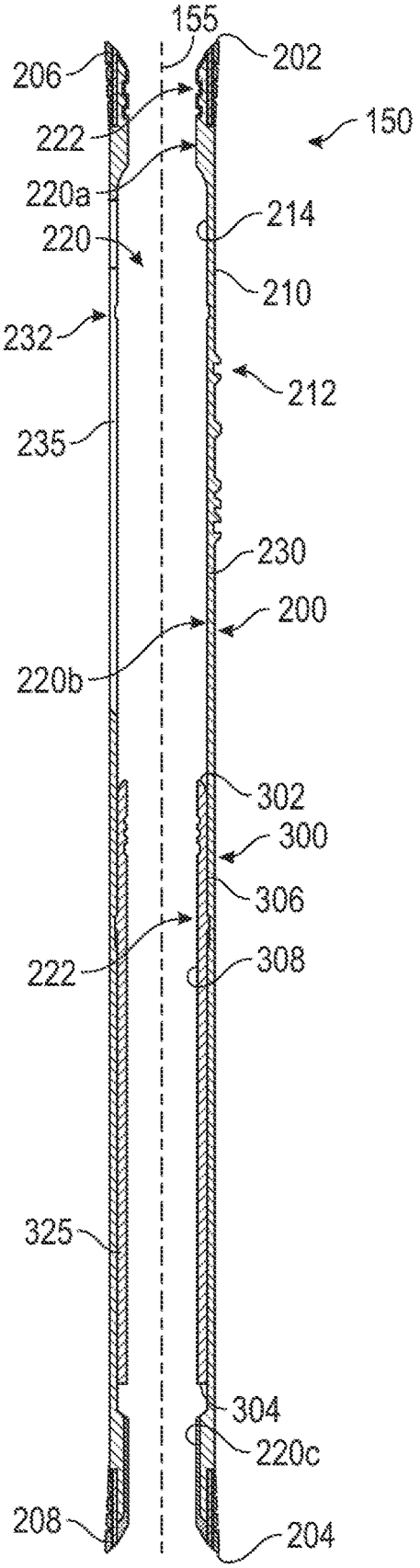
FIGS. 3A and 3B are cross sectional views of the protection sleeve assembly of FIGS. 1 and 2 in different orientations.

Shown deployed in FIGS. 1 and 2 is an assembly 150 for protecting downhole tools and equipment from degradation. FIG. 3A is a front cross sectional view of a portion of the well system of FIG. 2 with protection assembly 150 for protecting downhole tools and equipment from degradation. Protection assembly 150 comprises a barrier device portion 200 and a support device portion 300 coaxial about a central axis 155. The barrier device 200 is generally tubular with a first end 202, a second end 204, an outer surface 210 extending therebetween, and an inner surface 214 defining a passageway 220; the barrier device 200 may also be called a barrier sleeve 200. The passageway 220 has a smaller, inner diameter portion 220*a*, 220*c*, respectively, at each end 202, 204, respectively, and a larger, inner diameter portion 220*b* between the first and second ends 202, 204. The barrier sleeve 200 further includes a first seal 206 disposed proximate the first end 202 and a second seal 208 disposed proximate the second end 204. The seals 206, 208 prevent debris from entering the annulus between the protection sleeve assembly 150 and the casing 60, and may, but need not, provide a pressure barrier. The barrier sleeve 200 also includes, in an embodiment, a plurality of collet fingers 230 circumferentially spaced about central axis 155 and separated by longitudinal slots 232. In an embodiment, an elastomeric material 235 may be disposed in the slots 232 between the collet fingers 230.

The barrier sleeve outer surface 210 also includes an outer profile 212 that may include one or more annular cutouts and/or protrusions of varying geometry and size. The annular cutouts or grooves and/or the protrusions of outer profile 212 may be formed on any portion of barrier sleeve outer surface 210, including the portion that comprises the collet fingers 230. The barrier inner surface 214 includes an inner profile 222 that may include one or more cutouts and/or protrusions of varying geometry and size. The annular cutouts or grooves and/or the protrusions of inner profile 222 may be formed on any portion of barrier sleeve inner surface 214. The outer and inner profiles 212, 222 may each comprise any combination of grooves and protrusions. For example, outer and inner profiles, 212, 222, respectively, may include one or more grooves or channels that may have varying depths and widths and one or more protrusions that may have varying heights and widths. In an embodiment, the outer or inner profiles 212, 222 may include three or more of any combination of grooves/protrusions, where each groove/protrusion may be spaced at a regular or irregular distance apart from adjacent grooves/protrusions. For example, inner profile 222 may include cutouts or grooves and/or protrusions disposed proximate first end 202 or second end 204, or both, of barrier sleeve 200 in smaller, inner diameter portion 220*a*, 220*c* (indicated by 214*a*; see FIG. 4B, described in further detail below), disposed in larger, inner diameter portion 220*b*, or any combination thereof.

Figure 4A:
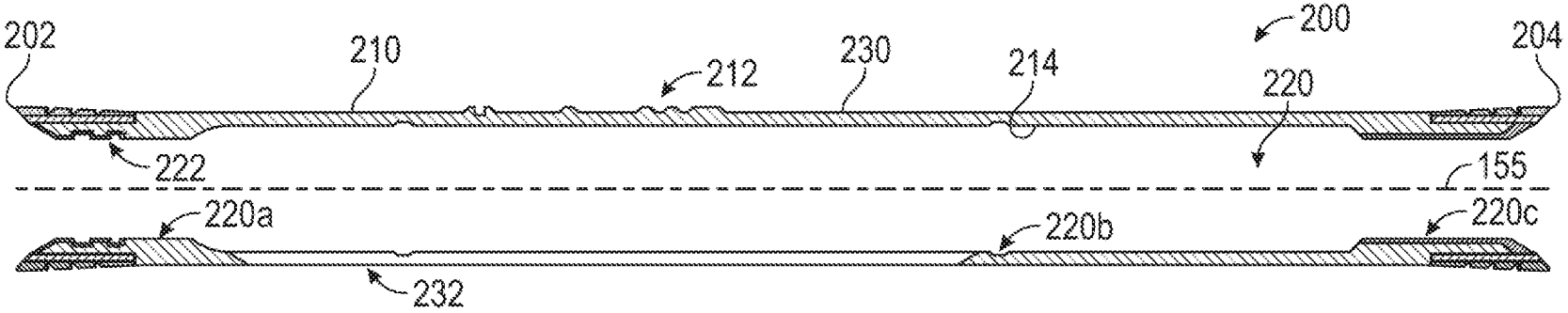
FIGS. 4A and 4B are a cross sectional views of a portion of the protection sleeve assembly of FIG. 3.
Figure 4B:
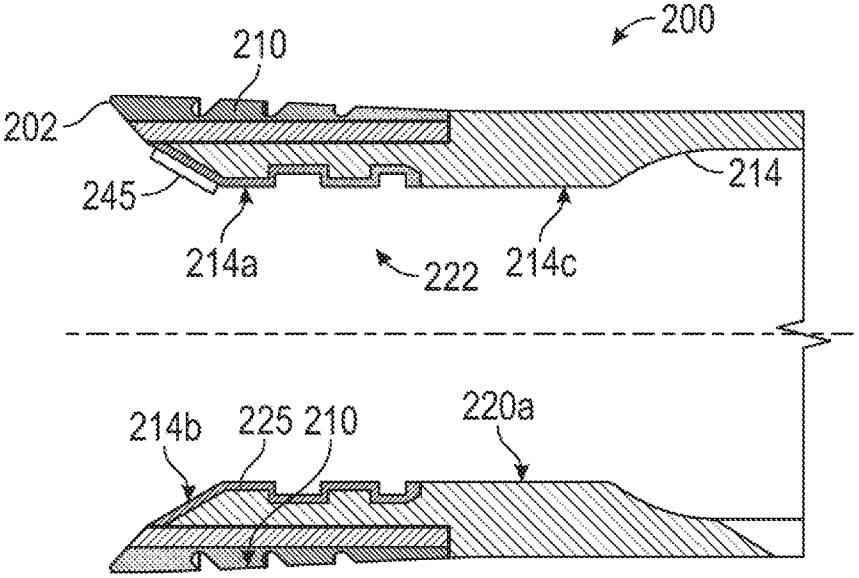

Referring now to FIG. 4A showing the barrier sleeve 200 and FIG. 4B showing a close up view of the first end 202 of the barrier sleeve 200 shown in FIG. 4A. In an embodiment, a section or portion of the inner surface 214 that extends from first end 202 and includes a portion of the inner profile 222 (indicated by 214*a*) may be made of an erosion- and corrosion-resistant material or a degradation-resistant material 225. The degradation-resistant material 225 may be any material known in the art having suitable erosion resistance and corrosion-resistance properties including, but not limited to, tungsten carbide, high velocity oxygen fuel (HVOF) coating, hardide coating, thermal spray coating, and ion plasma coating. In an embodiment, the degradation-resistant material 225 may be a coating applied to the section 214*a* of the inner surface 214. In another embodiment, various portions of inner surface 214 may be coated with or made from sacrificially erodible material, highly erodible material, highly un-erodible material, or a combination thereof. In particular, a portion 214*b* of inner surface 214 proximate first end 202 may have a beveled edge and be made from or coated with a sacrificially erodible material, while portion 214*a* may be made from or coated with a highly un-erodible material, or vice versa. Yet a further portion spaced away from first end 202 of barrier sleeve portion 200 (indicated by 214*c*) may be made from or coated with sacrificially erodible material or highly un-erodible material. In an alternative embodiment, additional material 245 may be added to or form part of portion 214*b* and may be a sacrificially erodible material.

Figure 5:
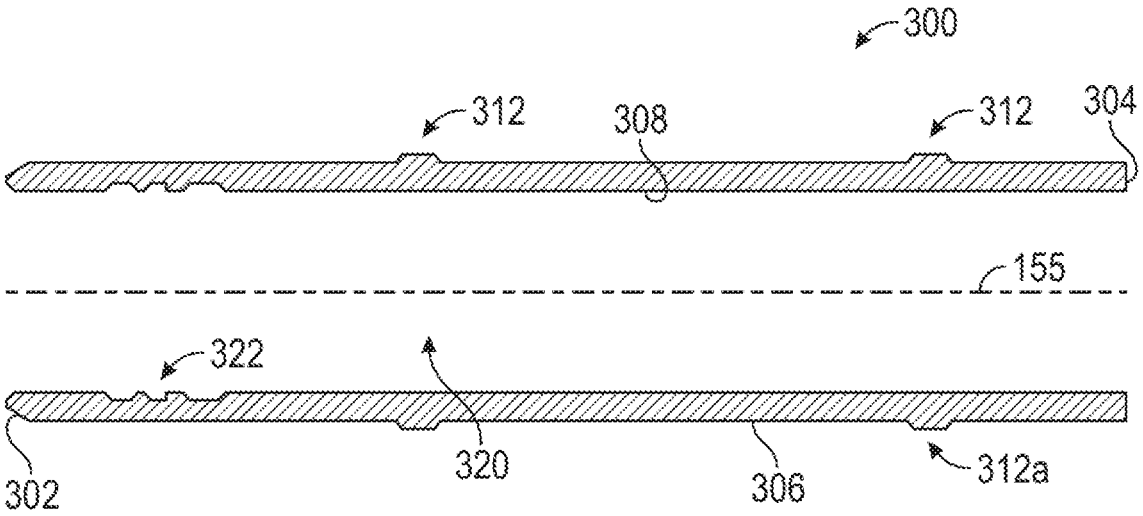
FIG. 5 is a cross sectional view of a portion of the protection sleeve assembly of FIG. 3.

Referring now to FIG. 5 showing the support device portion 300. Support device 300 is generally tubular with a first end 302, a second end 304, an outer surface 306 extending therebetween, and an inner surface 308 defining a passageway 320; the support device 300 may also be called a support sleeve 300. The support sleeve outer surface 306 also includes an outer profile 312 that may include one or more annular cutouts and/or protrusions of varying geometry and size. The annular cutouts or grooves and/or the protrusions of outer profile 312 may be formed on any portion of support sleeve outer surface 306. The support sleeve inner surface 308 includes an inner profile 322 that may include one or more cutouts and/or protrusions of varying geometry and size. The annular cutouts or grooves and/or the protrusions of inner profile 322 may be formed on any portion of support sleeve inner surface 308. For example, one or more grooves or channels may have varying depths and widths and one or more protrusions may have varying heights and widths. The outer and inner profiles 312, 322 may each comprise any combination of grooves and protrusions. In an embodiment, inner profile 322 may include cutouts or grooves and/or protrusions disposed proximate first end 302 of support sleeve portion 300. Further, the support sleeve portion 300 may be made of an erosion- and corrosion-resistant material or a degradation-resistant material 325. The degradation-resistant material 325 may be any material known in the art having suitable erosion resistance and corrosion-resistance properties including, but not limited to, tungsten carbide, high velocity oxygen fuel (HVOF) coating, hardide coating, thermal spray coating, and ion plasma coating.

Figure 3B:
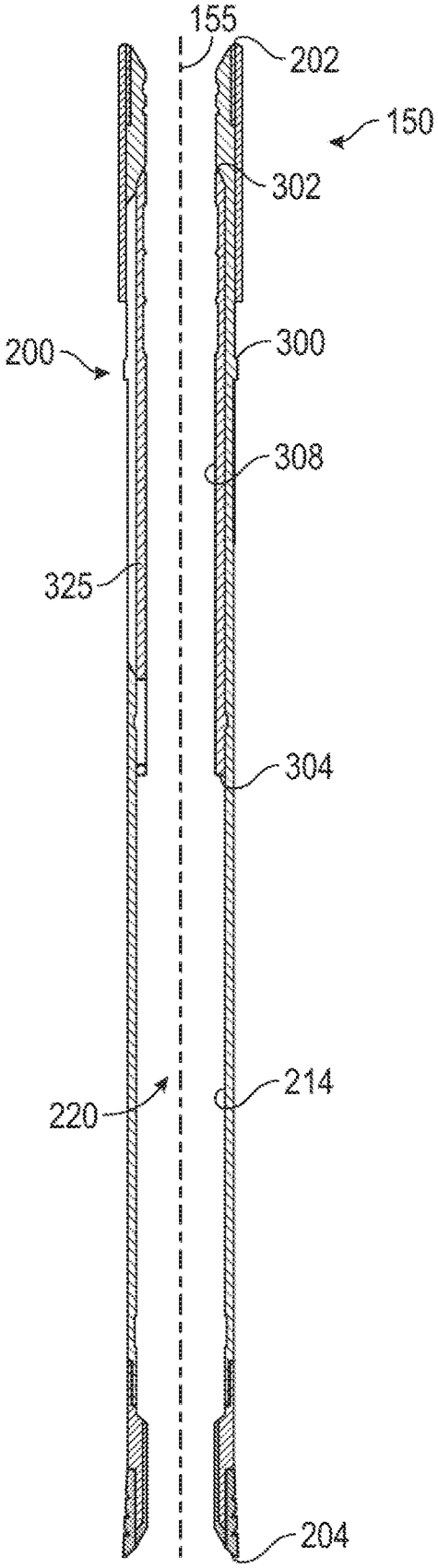

Referring now to FIGS. 3A, 3B, 4A, and 5, the support sleeve portion 300 is movably disposed in barrier sleeve portion 200 such that outer surface 306 of support sleeve portion 300 may be in sliding contact with the larger, inner diameter portion 220*b* of inner surface 214 of barrier sleeve portion 200. In a first position, support sleeve portion 300 may be disposed in barrier sleeve portion passageway 220 such that support sleeve second end 304 is disposed proximate barrier sleeve second end 204 (FIG. 3A). A protrusion of support sleeve outer profile 312 may align with a groove of barrier sleeve portion inner profile 222 to lock the support sleeve 300 stationary in first position relative barrier sleeve 200 when the groove and opposing protrusion are engaged. Likewise, the support sleeve outer profile 312 may include a groove that may align with and engage a protrusion of barrier sleeve inner profile 222. In a second position, support sleeve portion 300 may be disposed in barrier sleeve passageway 220 such that support sleeve first end 302 is disposed proximate barrier sleeve first end 202 (FIG. 3B). A protrusion of support sleeve outer profile 312 may align with a groove of barrier sleeve portion inner profile 222 to lock the support sleeve 300 stationary in second position relative barrier sleeve 200 when the groove and opposing protrusion are engaged. Likewise, the support sleeve outer profile 312 may include a groove that may align with and engage a protrusion of barrier sleeve inner profile 222. When support sleeve 300 is in the second position, support sleeve 300 is adjacent the collet fingers 230 of the barrier sleeve. While the barrier sleeve 300 is adjacent the collet fingers 230, the collet fingers are unable to bend or flex radially inward.

Figure 6:
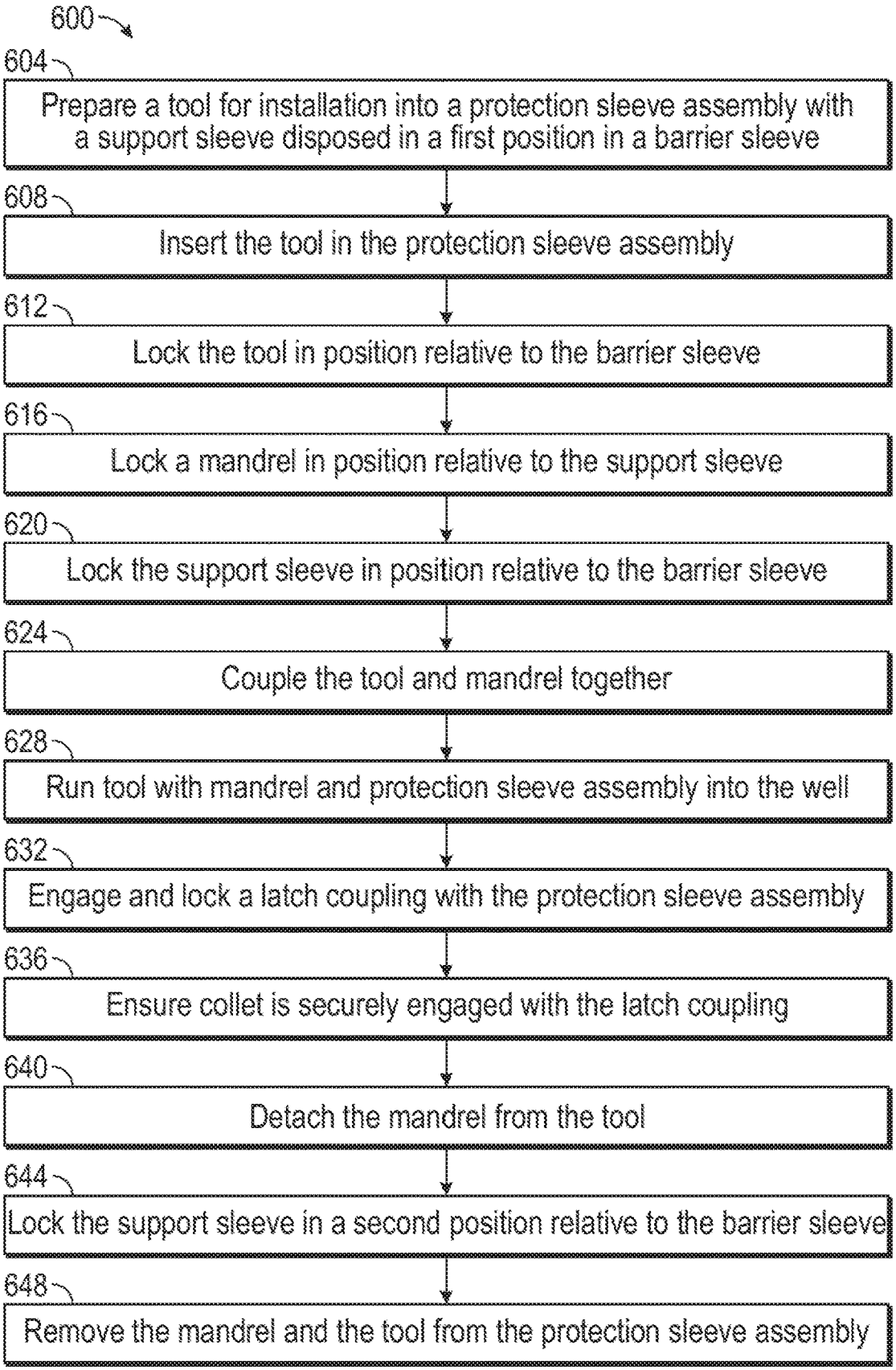
FIG. 6 illustrates embodiments of a method for installing the protection sleeve assembly of FIG. 3.

In an exemplary embodiment and as illustrated in FIG. 6, with continuing reference to FIGS. 1-5, a method 600 of protecting downhole tools and equipment from degradation is described. The method 600 may be utilized for preventing, reducing, and/or eliminating erosion and corrosion of downhole tools and equipment from fluids with erosional characteristics. For example, during pumping of fracturing sand or fracturing slurry.

Figure 7:
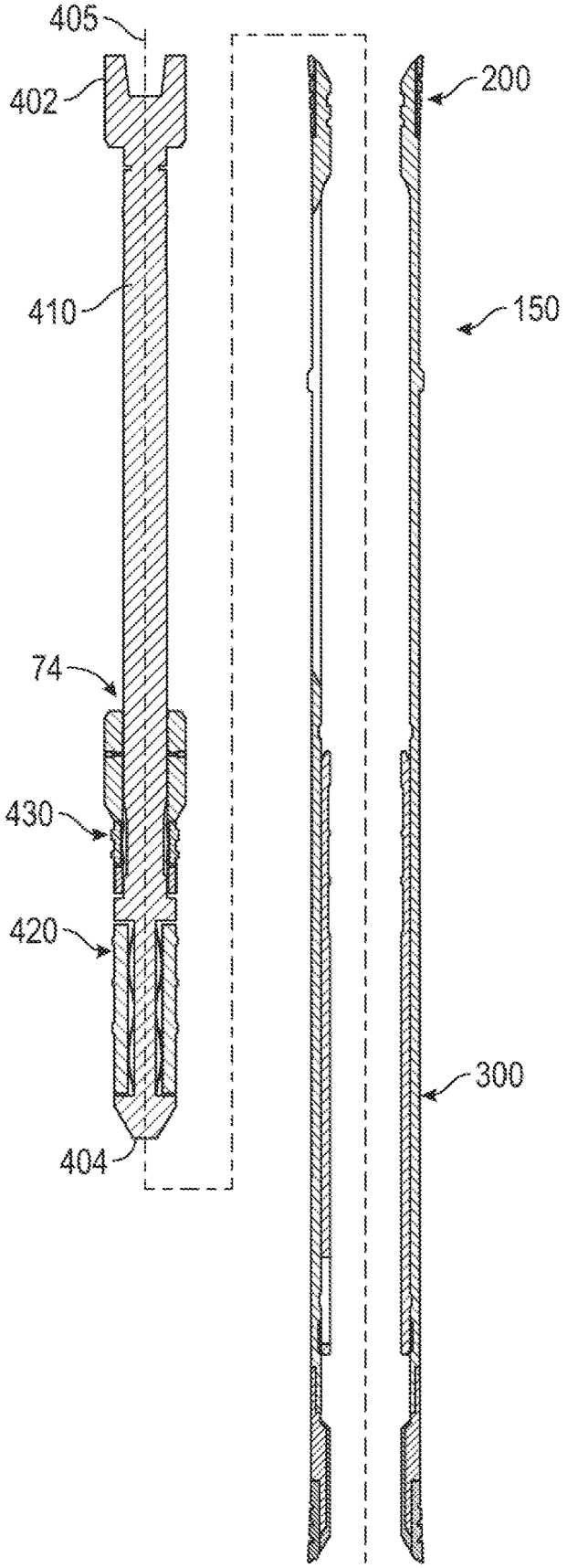
FIGS. 7, 8 and 9A are cross sectional views of a tool in various stages of interfacing with the protection sleeve assembly of FIG. 3.
Figure 8:
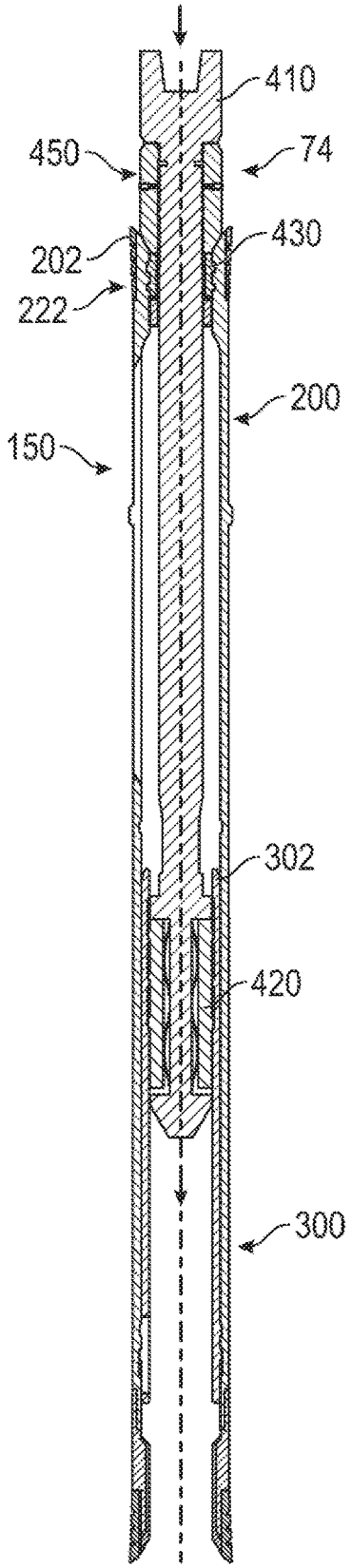

In a first step 604, a tool 74 slidingly disposed on a mandrel 410 that is connectable to pipe system 58 (FIGS. 1 and 2) is prepared for installation into protection sleeve assembly 150 with support sleeve 300 disposed in and engaging barrier sleeve 200 in the first position. Referring to FIG. 7, the mandrel 410 comprises a first end 402, a second end 404, and a first and second set of keys 420, 430, respectively, disposed about mandrel 410 proximate the second end 404 and coaxial about axis 405. Outer surfaces of first and second sets of keys 420, 430, respectively, may each comprise any combination of grooves and protrusions. The first and second sets of keys 420, 430 may be radially compressible and expandable about central axis 405.

Referring also to FIGS. 4A, 4B, 6, and 8, shown is tool 74 with mandrel 410 interfacing with the protection sleeve assembly 150. In step 608, the tool 74 is inserted in protection assembly 150. The first set of keys 420 compress as they pass portion 214*a* of the inner profile 222 at first end 202 of the barrier sleeve portion 200, and expand radially back outward after clearing portion 214*a* of the inner profile 222 at first end 202. As the mandrel 410 continues moving into passage 220, the second set of keys 430 also compress as they interface portion 214*a* of inner profile 222 at first end 202 of the barrier sleeve portion 200.

In step 612, the tool 74 in locked in position relative the barrier sleeve 200. The second set of keys 430 may radially expand slightly allowing grooves and protrusions of the second set of keys 430 to engage opposing protrusions and grooves on portion 214*a* of the inner profile 222 at first end 202 of the barrier sleeve portion 200 to maintain the position of tool 74 stationary relative to barrier sleeve 200 at first end 202. In other words, as the mandrel 410 continues moving into passage 220 and slidingly passes through a central bore of the tool 74, the second set of keys 430 remain engaged with portion 214*a* of the inner profile 222 of the barrier sleeve portion 200.

In step 616, the mandrel 410 is locked in position relative the support sleeve 300. The mandrel 410 continues to pass through the central bore of the tool 74, and the first set of keys 420 may compress again as they enter and engage the inner profile 322 at first end 302 of the support sleeve 300. The first set of keys 420 may radially expand slightly allowing grooves and protrusions of the first set of keys 420 to engage opposing protrusions and grooves on the inner profile 322 proximate first end 302 of the support sleeve 300 to maintain the position of mandrel 410 stationary relative to support sleeve 300 proximate support sleeve first end 302. In other words, any further movement of the mandrel 410 will also move support sleeve 300 an equivalent amount in the same direction.

In step 620, the support sleeve 300 is locked in position relative the barrier sleeve 200. The mandrel 410 with the support sleeve 300 moves toward barrier sleeve second end 204 to allow a protrusion in support sleeve outer profile 312 to engage a groove in barrier sleeve inner profile 222 to maintain the position of the support sleeve 300 stationary relative to barrier sleeve 200. In an embodiment, the protrusion may be in barrier sleeve inner profile 222 and the groove may be in support sleeve outer profile 312. In an alternative embodiment, the support sleeve outer profile 312 and the barrier sleeve inner profile 222 may each have a plurality of grooves and protrusions that oppositely align and engage one another.

In step 624, the tool 74 and the mandrel 410 are coupled together. The mandrel 410 may be raised with both barrier sleeve 200 and support sleeve 300 to allow access to the tool 74 and mandrel 410, which may be coupled together with any fastener known in the art including, but not limited to, shear screws 450.

Figure 9A:
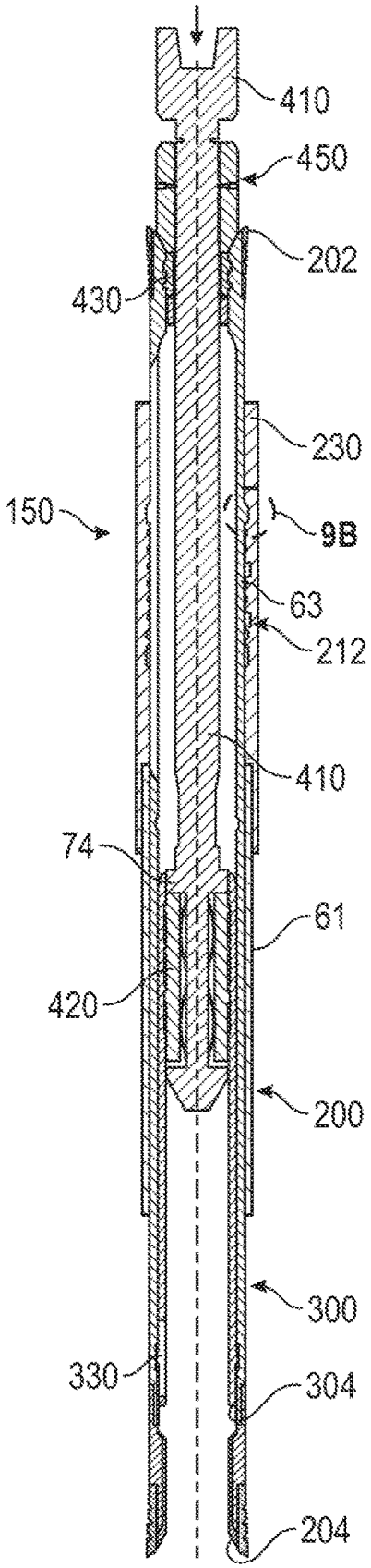
Figure 9B:
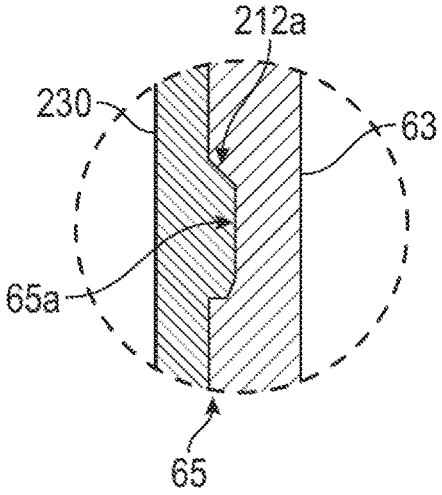
FIG. 9B is a detailed cross sectional view of a portion of protection sleeve assembly and latch coupling of FIG. 9A.

Referring now to FIGS. 6, 9A, and 9B, in step 628, the tool 74 is run into the well with the protection sleeve assembly 150 to a location or depth where a component, opening, profile, or surface needs to be protected. The component to be protected may be any downhole component needing protection from fluids with erosional and or corrosive properties including, but not limited to, latch couplings, valves, side pocket mandrels, seals, junction isolation tools (JIT), etc. In the present embodiment, a latch coupling 63 is protected by protection sleeve assembly 150. In another embodiment, the protection sleeve assembly 150 may be run into the well separately from the tool 74.

In step 632, the latch coupling 63 is engaged by protection sleeve assembly 150. The latch coupling 63 is generally tubular and includes a profile 65 having one or more grooves and/or protrusions 65*a* on an interior surface. The interior profile is protected by the protection sleeve assembly 150 from debris that may erode the profile 65. The latch coupling 63 may be used to connect casing joints 61. The barrier sleeve second end 204 is inserted into the latch coupling 63. With the support sleeve 300 in the first position, as previously described in step 604, the collet fingers 230 may be compressed radially inward to pass through the latch coupling 63. Alignment of a shoulder or protrusion 212*a* in outer profile 212 (shown in FIG. 4A) of the collet fingers 230 with a groove or cutout 65*a* in the latch coupling 63 allows the protrusion 212*a* to move radially outward into the groove 65*a*, shown in more detail in FIG. 9B. In an embodiment, the collet fingers 230 may be elastically bent radially inward such that when the protrusion 212*a* of outer profile 212 comes in proximity with the groove 65*a* in the latch coupling 63, the protrusion 212*a* springs out into cutout 65*a*. In an embodiment, the locations of the groove and protrusion may be swapped; in an alternative embodiment, the collet fingers 230 and latch coupling 63 may each have a plurality of grooves and protrusions.

In step 636, the engagement of the collet fingers 230 to the latch coupling 63 is checked. In an embodiment, tension may be placed on the mandrel 410, which is coupled to the support sleeve 300 via keys 420, which is in turn coupled to the barrier sleeve 200 via a collet 330 proximate the second end 304 of support sleeve 300, which is engaged in the groove proximate the second end 204 of barrier sleeve 200. Barrier sleeve 200 is in turn coupled to the latch coupling 63 via groove 65*a* and protrusion 212*a*. In another embodiment, a wireline or coil tubing may be used to run the running tool 74 and compression may be placed on the mandrel 410 by jarring down on the running tool 74, which is transferred from the mandrel 410 through the shear screws 450 and into the first barrier sleeve end 202.

In step 640, the mandrel 410 is detached from the tool 74. The tool 74 may be lowered further into the wellbore 12 when the protrusion 212*a* on the collet fingers 230 is securely engaged in the groove 65*a* on the latch coupling 63. The shear screws 450 may be sheared by any means standard in the art including, but not limited to, using the weight of the work string or running down a set of jars if wireline or coiled tubing is used to run the running tool 74 and protection sleeve assembly 150. In an embodiment, the tool 74 may be lowered further into the wellbore 12 when the protrusion 212*a* on the collet fingers 230 is securely engaged in the groove 65*a* on the latch coupling 63, such that the weight of the pipe system 58 shears the shear screws 450 to allow the mandrel 410 to move relative the tool 74.

Figure 10A:
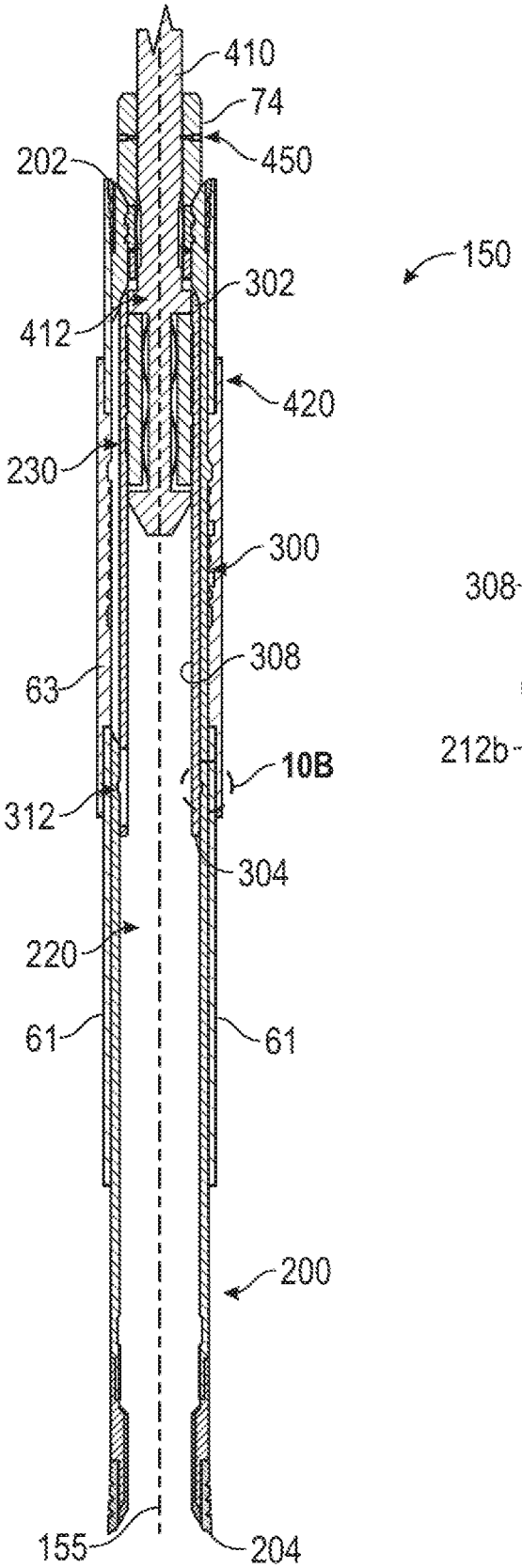
FIG. 10A is a cross sectional view of a tool interfacing with the protection sleeve assembly of FIG. 3.
Figure 10B:
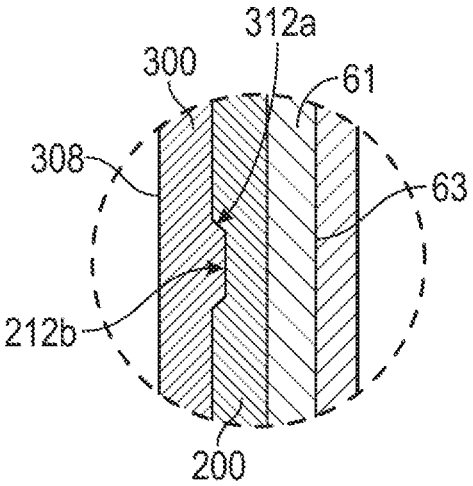
FIG. 10B is a detailed cross sectional view of a portion of protection sleeve assembly and latch coupling of FIG. 10A.

Referring now to FIGS. 6, 10A, and 10B, in step 644, the support sleeve 300 is locked in the second position relative the barrier sleeve 200. With the shear screws 450 sheared, the mandrel 410 may be raised with the keys 420 still engaging the support sleeve 300 to raise the support sleeve 300 within the barrier passageway 220. The support sleeve 300 is moved to the second position in barrier sleeve passageway 220 such that support sleeve first end 302 is disposed proximate barrier sleeve first end 202. In the second position, the support sleeve 300 is adjacent and coaxial with collet fingers 230. Alignment of a shoulder or protrusion 312*a* in outer profile 312 of the support sleeve 300 with a groove or cutout 212*b* in the barrier sleeve 200 allows the protrusion 312*a* to move radially outward into the groove 212*b*, shown in more detail in FIG. 10B.

Figure 11:
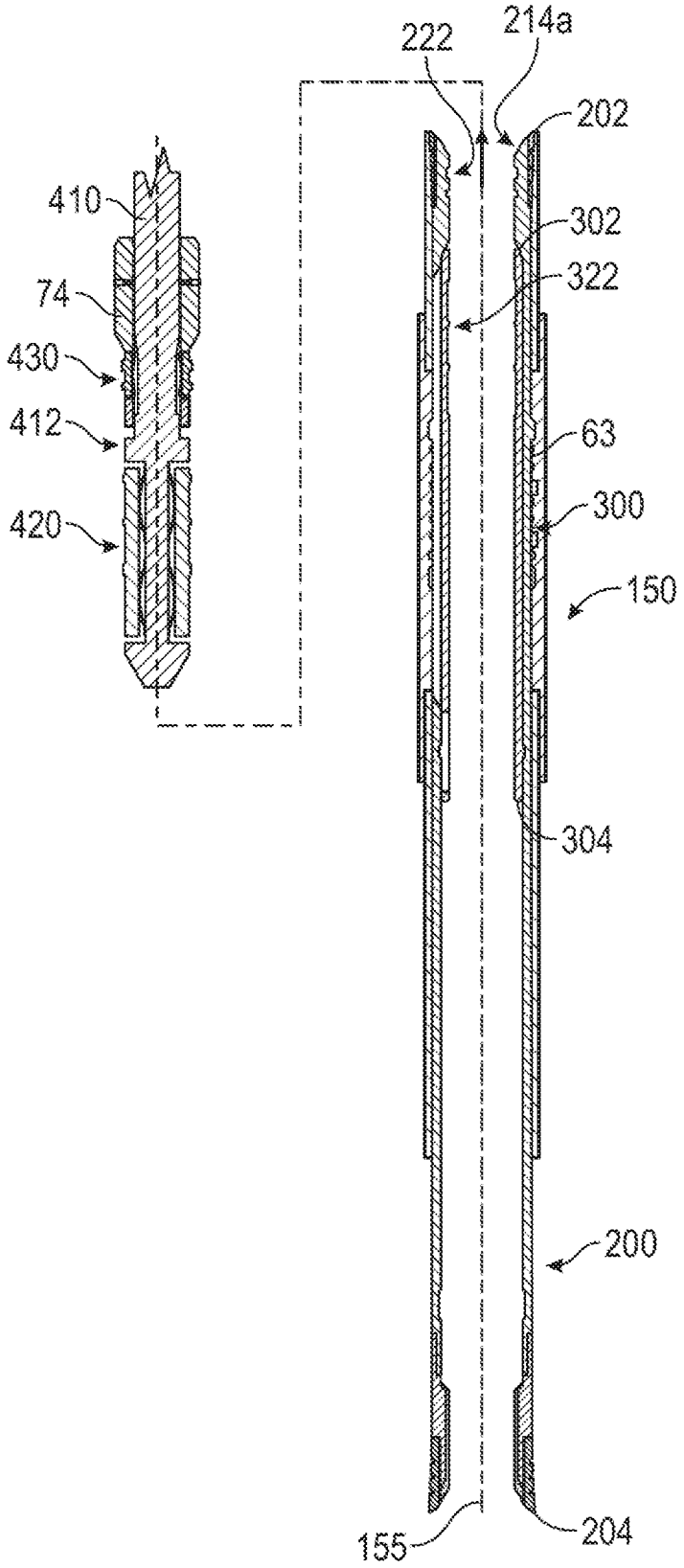
FIG. 11 is a cross sectional view of a tool interfacing with the protection sleeve assembly of FIG. 3.

Referring now to FIGS. 6 and 11, in step 648, the mandrel 410 and tool 74 are removed from the protection sleeve assembly 150 while the protection sleeve assembly 150 is installed in latch coupling 63. The mandrel 410 and tool 74 continue to be raised; a structure or shoulder 412 on the mandrel 410 reaches and engages tool 74. With continued upward movement, shoulder 412 dislodges the second set of keys 430, compressing the keys 430 and moving out of engagement with interface portion 214*a* of inner profile 222 at first end 202 of the barrier sleeve portion 200 (see FIG. 4B). As the second set of keys 430 clears the barrier sleeve 200, the keys 430 radially expand back to a neutral position. As the mandrel 410 and tool 74 continue to be raised, the first set of keys 420 are compressed again as they move out of engagement with the inner profile 322 at first end 302 of the support sleeve 300 and then move out of engagement with interface portion 214*a* of inner profile 222 at first end 202 of the barrier sleeve portion 200. As the first set of keys 420 clears the barrier sleeve 200, the keys 420 radially expand back to a neutral position. With keys 420 disengaged from the barrier sleeve 200, the mandrel 410 and tool 74 are clear of the protection sleeve assembly 150 and can be pulled out of the wellbore 12.

Figure 12:
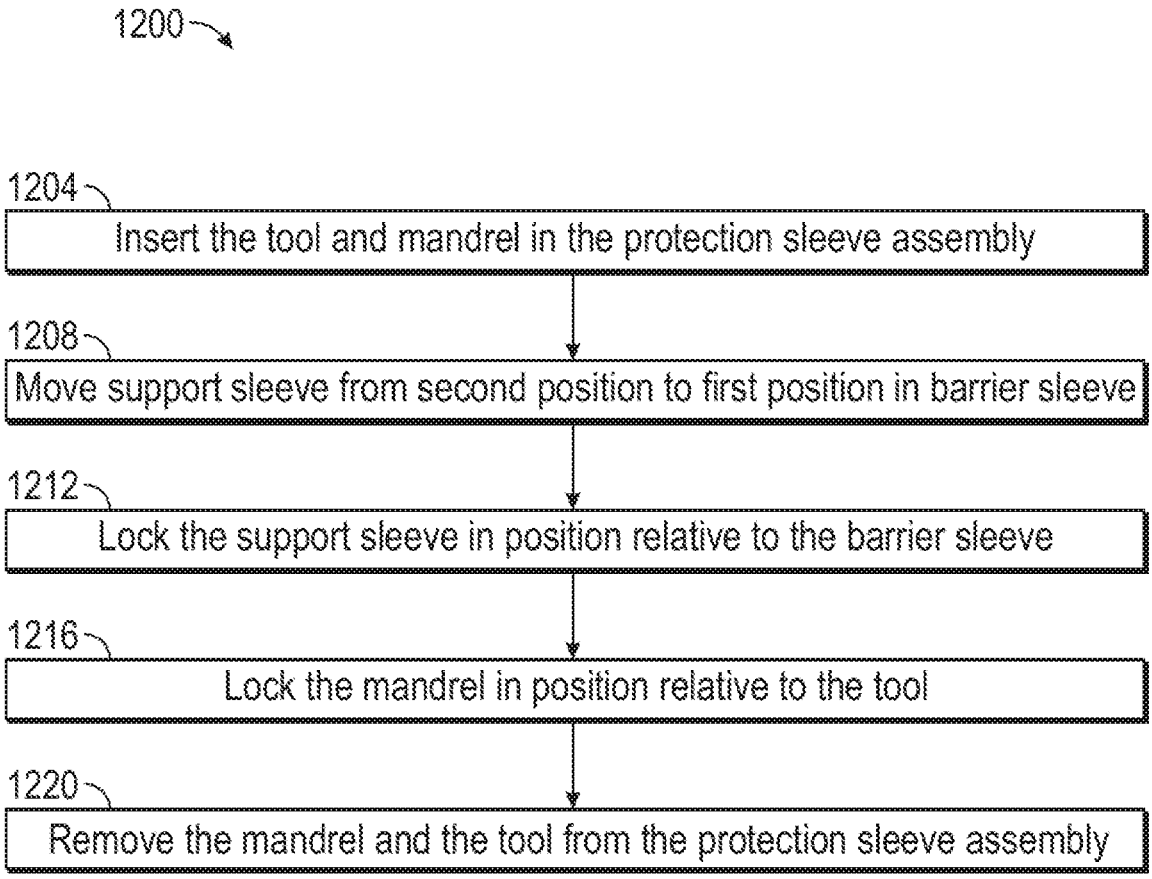
FIG. 12 illustrates embodiments of a method for retrieving the protection sleeve assembly of FIG. 3.

In an exemplary embodiment and as illustrated in FIG. 12, with continuing reference to FIGS. 1-5, a method 1200 of retrieving an assembly 150 for protecting downhole tools and equipment from degradation is described. Once operations involving fluids with erosional and corrosive characteristics are complete and the downhole tools and equipment being protected from the fluids no longer needs protection, the protection sleeve assembly 150 may be removed.

In step 1204, the tool 74 with mandrel 410 (see FIG. 7) is run into the wellbore 12 and inserted in protection assembly 150. The first set of keys 420 compress as they pass portion 214*a* of the inner profile 222 at first end 202 of the barrier sleeve portion 200 and remain compressed as they pass into support sleeve passageway 320. As the mandrel 410 continues moving into passage 220, the second set of keys 430 also compress as they interface portion 214*a* of inner profile 222 at first end 202 of the barrier sleeve portion 200. The second set of keys 430 may radially expand slightly allowing grooves and protrusions of the second set of keys 430 to engage opposing protrusions and grooves on portion 214*a* of the inner profile 222 at first end 202 of the barrier sleeve portion 200 to maintain the position of tool 74 stationary relative to barrier sleeve 200 at first end 202.

Figure 13:
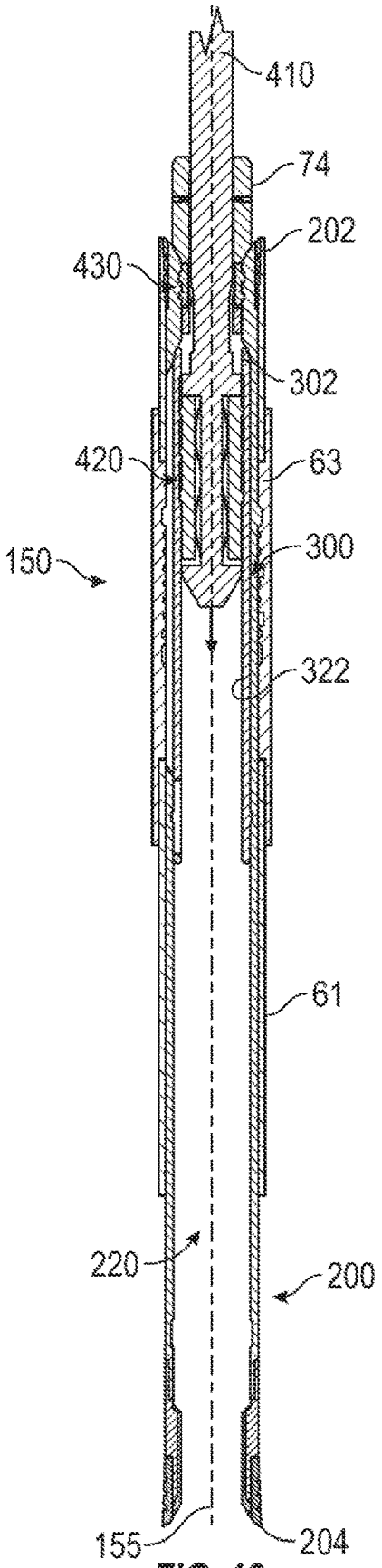
FIGS. 13-15 are cross sectional views of a running tool in various stages of interfacing with the protection sleeve assembly shown in FIG. 3.

Referring now to FIGS. 12 and 13, in step 1208, the support sleeve 300 is moved from the second position to the first position in barrier sleeve passageway 220. As the mandrel 410 continues slidingly moving through the central bore of the tool 74, the second set of keys 430 remain engaged with portion 214*a* of the inner profile 222 (see FIG. 4B) of the barrier sleeve portion 200. The first set of keys 420 radially expand slightly allowing grooves and protrusions of the first set of keys 420 to engage opposing protrusions and grooves on the inner profile 322 proximate first end 302 of the support sleeve 300 to maintain the position of mandrel 410 stationary relative to support sleeve 300 proximate support sleeve first end 302. The support sleeve 300, now engaged with the mandrel 410 via keys 420, moves downward with the mandrel 410 dislodging the shoulder or protrusion 312*a* in outer profile 312 (see FIG. 5) of the support sleeve 300 out of groove 212*b* in the barrier sleeve 200. With the support sleeve 300 disengaged from the barrier sleeve 200, the support sleeve 300 may move downward with the mandrel 410 from the second position in barrier sleeve passageway 220, adjacent to and coaxial with barrier sleeve 200, to the first position in barrier sleeve passageway 220, where support sleeve second end 304 is disposed proximate barrier sleeve second end 204.

Figure 14:
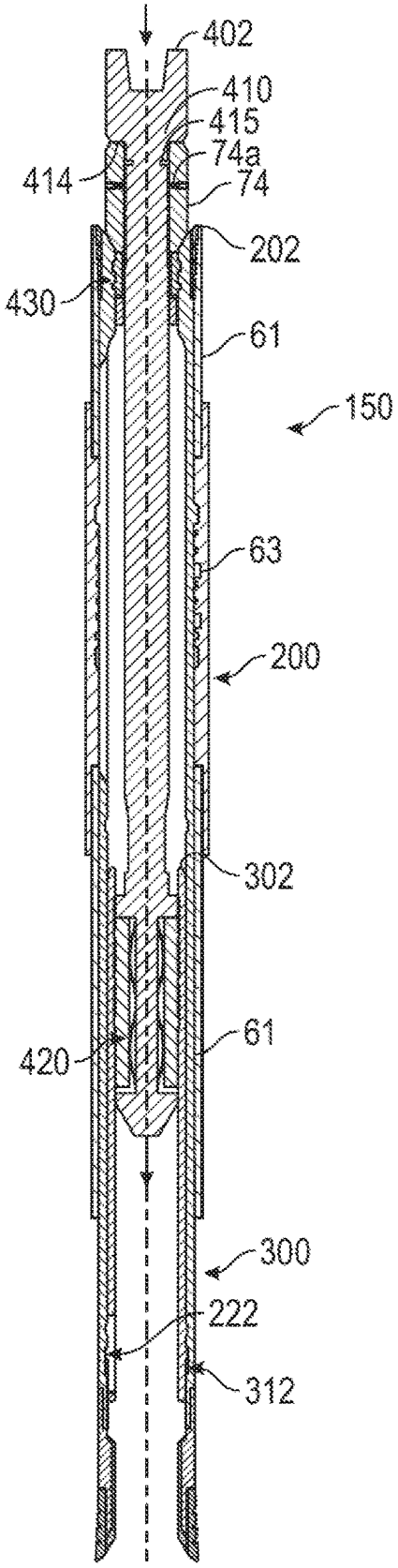

Referring now to FIGS. 12 and 14, in step 1212, the support sleeve 300 is locked in position relative the barrier sleeve 200. Alignment and engagement of a protrusion on support sleeve outer profile 312 with a groove of barrier sleeve portion inner profile 222 locks the support sleeve 300 stationary in first position relative barrier sleeve 200.

In step 1216, the mandrel 410 is locked in position relative the tool 74. The mandrel 410 ceases downward movement when a shoulder 414 on the mandrel 410 abuts the tool end 402. The mandrel 410 further includes at least one fastener 415 that engages an indention or groove 74*a* in tool 74; the at least one fastener 415 springs out into indention 74*a* to allow the mandrel 410 and tool 74 to pull the protection sleeve assembly 150 out of the wellbore 12. The fastener may be any mechanical fastener known in the art including, but not limited to, a snap ring, a retention ring, or other a spring-loaded fastener.

Figure 15:
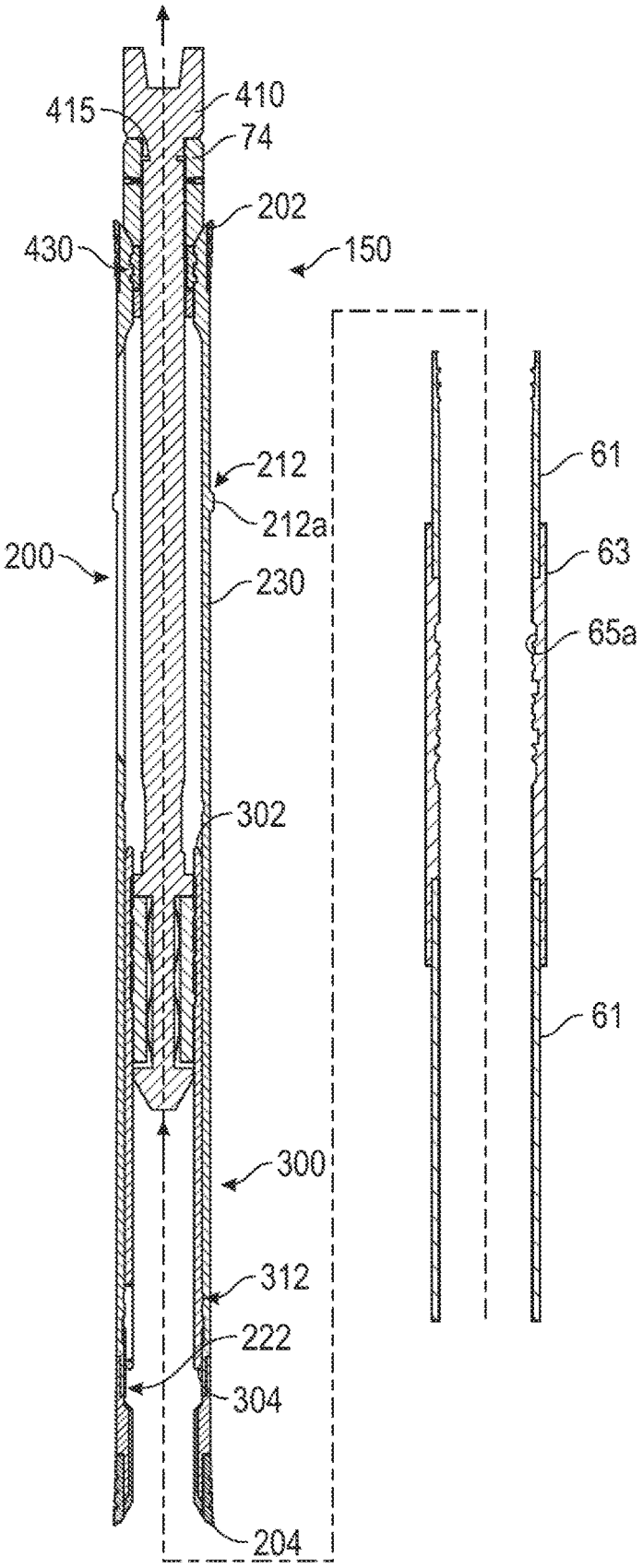

Referring now to FIGS. 12 and 15, in step 1220, the protection sleeve assembly 150 is removed from the latch coupling 63. With the support sleeve 300 in the first position, as previously described, the collet fingers 230 may be compressed radially inward to pass through the latch coupling 63. Protrusion 212*a* in outer profile 212 of the collet fingers 230 moves radially inward away from groove 65*a* in the latch coupling 63, dislodging the protrusion 212*a* from the groove 65*a* as the mandrel 410 and tool 74 are raised. Protection sleeve assembly may be pulled out of the wellbore 12 with fastener 415 coupling the mandrel 410 and the tool 74 together, keys 430 on mandrel 410 engaged with interface portion 214*a* of inner profile 222 (see FIG. 4B) at first end 202 of the barrier sleeve portion 200, and support sleeve 300 secured in the first position within barrier sleeve 200 via engagement of a protrusion on support sleeve outer profile 312 with a groove of barrier sleeve portion inner profile 222.

Figure 16:
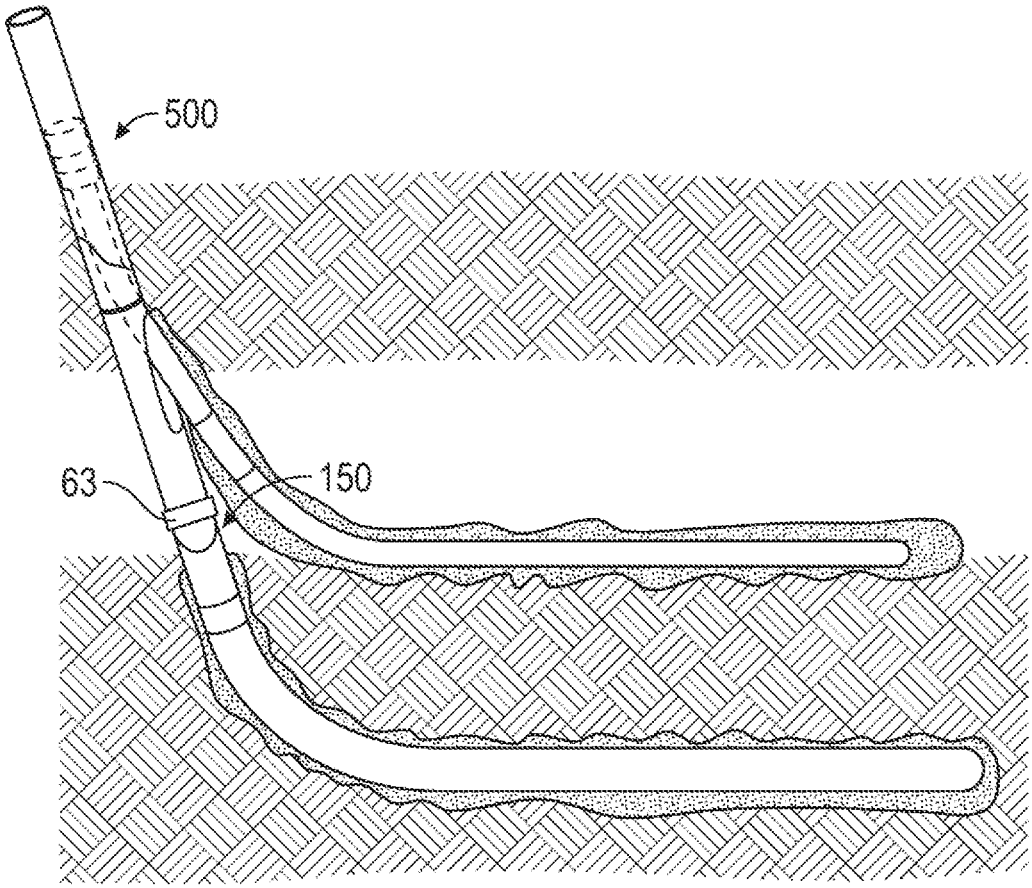
FIG. 16 is an elevation view in partial cross section of a well system with a protection system to mitigate degradation of downhole tools and equipment according to an embodiment.

In an embodiment, more than one protection sleeve assembly 150 may be deployed in a wellbore 12, and may be releasably positioned and removed in an order. In an alternative embodiment, the protection sleeve assembly 150 may be installed to protect a downhole tool or surface in conjunction with running another tool or device into the wellbore 12. For example, the protection sleeve assembly 150 may be installed to protect a latch coupling 63 during the same run that a junction isolation tool (JIT) 500 is run (FIG. 16). The JIT 500 may be any JIT standard in the art. In an embodiment, two protection sleeve assemblies 150 may be deployed to protect two latch couplings 63 on the same run that a JIT 500 is run.

Figure 17A:
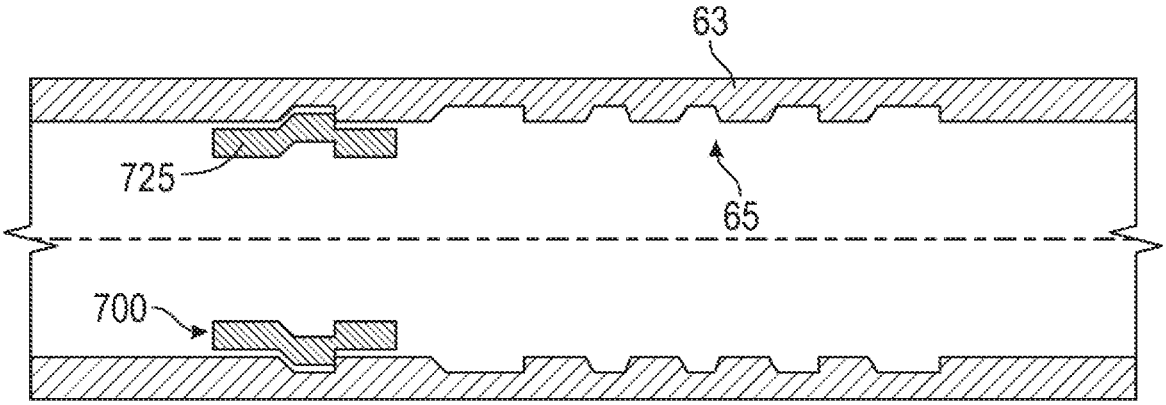
FIGS. 17A and 17B are cross sectional views of a latch coupling a protection system to mitigate degradation of downhole tools and equipment according to an embodiment.
Figure 17B:
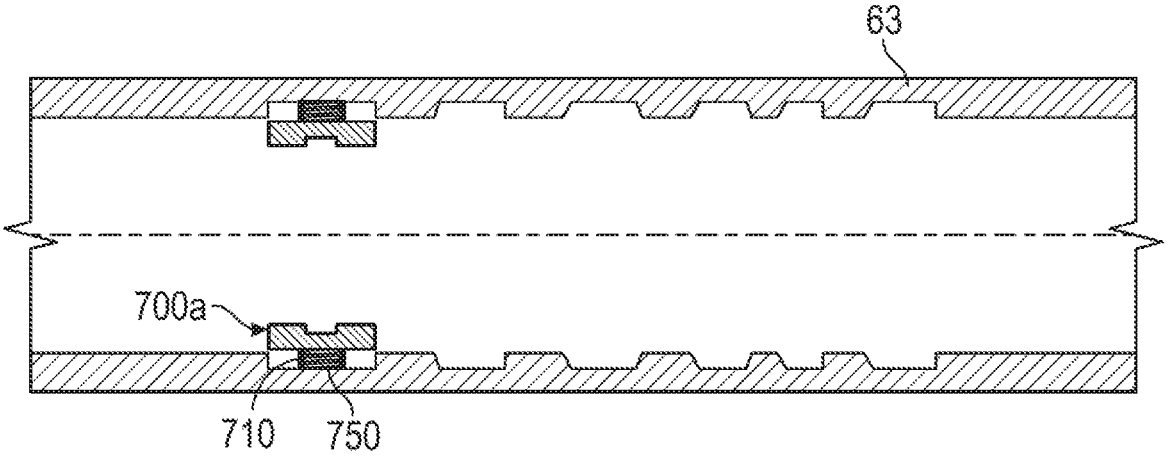

Referring now to FIGS. 17A and 17B, in an alternative embodiment, the latch coupling interior profile 65 may be protected from erosion-causing fluids with a fluid diverter 700 (FIG. 17A) or a spring-activated fluid diverter 700*a* (FIG. 17B). The fluid diverter 700 may be made of or coated with highly un-erodible material, may be made of an erosion- and corrosion-resistant material or a degradation-resistant material 725. The degradation-resistant material 725 may be any material known in the art having suitable erosion resistance and corrosion-resistance properties including, but not limited to, tungsten carbide, high velocity oxygen fuel (HVOF) coating, hardide coating, thermal spray coating, and ion plasma coating. In an embodiment, the fluid diverter 700 may be run in with lower lateral fracturing tools and retrieved after the fracturing operations are complete. In an alternative embodiment, the fluid diverter 700 may be made of or coated with a highly erodible material intended to be sacrificed to prevent or reduce damage to the interior profile 65. In another embodiment, the fluid diverter may be spring-activated 710 and reside in a groove or cutout 750 when the fluid diverter is not activated. The spring-activated fluid diverter 700*a* may be activated by the fracturing tool and retrieved after the fracturing operations are complete. In an alternative embodiment, the fluid diverter 700, 700*a* may be left in the latch coupling 63 and simply erode away or get pushed back by the fracturing tool.

Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed; rather, the intention is to cover all modifications, equivalents, and alternatives falling within the spirit and scope of the disclosure as defined by the appended claims.

Thus, an assembly that protects a downhole tool from degradation due to erosional or corrosive fluids has been described. Embodiments of the assembly may generally include a barrier sleeve having a first end, a second end, an outer surface, and an inner surface forming a passageway, the inner surface of the barrier sleeve including at least one groove forming a profile, and a support sleeve disposed in the barrier sleeve portion, the outer surface of the support sleeve including at least one protrusion forming a profile, wherein at least a portion of an outer surface of the support sleeve portion is in contact with an inner surface of the barrier sleeve portion, wherein in a first position, the profile of the barrier sleeve aligns with and releaseably engages the profile of the support sleeve. Other embodiments of an assembly that protects a downhole tool from degradation due to erosional or corrosive fluids may generally include a barrier sleeve having a first end, a second end, an outer surface, and an inner surface forming a passageway, and a support device movably disposed in the barrier sleeve, wherein the barrier sleeve is disposed between the downhole tool and the erosional or corrosive fluids, wherein in a first position, the support device releasably engages the barrier sleeve. Likewise, a system for protecting a downhole tool from degradation due to erosional or corrosive fluids may generally include a tool having a central bore, a mandrel slidingly disposed through the central bore and having a first and second set of keys, a barrier sleeve having a first end, a second end, an outer surface, and an inner surface forming a passageway, and a support sleeve having a first end, a second end, an outer surface, and an inner surface forming a passageway, the support sleeve slidingly disposed in the barrier sleeve, wherein the first and second sets of keys releasably engage at least one groove on the inner surface of the barrier sleeve. Other embodiments of a system for protecting a downhole tool from degradation due to erosional or corrosive fluids may generally include a tool having a central bore, a mandrel slidingly disposed through the central bore and having a first and second set of keys, a barrier sleeve having a first end, a second end, an outer surface, and an inner surface forming a passageway, and a support sleeve having a first end, a second end, an outer surface, and an inner surface forming a passageway, the support sleeve slidingly disposed in the barrier sleeve, wherein the first and second sets of keys releasably engage a profile on the inner surface of the barrier sleeve.

For any of the foregoing embodiments, the assembly may include any one of the following elements, alone or in combination with each other.

The barrier sleeve further comprises a plurality of collet fingers.

The barrier sleeve further comprises a first annular seal disposed at the first end and second annular seal disposed at the second end.

The inner surface of the barrier sleeve comprises a degradation-resistant material.

Additional material that is easily erodible is added to a portion of inner surface of the barrier sleeve.

The degradation-resistant material is a coating.

The barrier sleeve includes a fluid diverter.

An outer surface of the support device includes at least one protrusion forming a profile.

The inner surface of the barrier sleeve includes a profile that releaseably engages the profile of the support device.

The barrier sleeve further comprises at least one annular seal disposed at one of the first end and the second end.

A portion of the barrier sleeve comprises a degradation-resistant material.

Additional material that is highly erodible is added to a portion of inner surface of the barrier sleeve.

The degradation-resistant material is a coating.

The barrier sleeve includes a fluid diverter.

The fluid diverter comprises a highly erodible material.

The assembly is integral with the downhole tool.

The assembly is run into the well separately from the downhole tool.

The outer surface of the support sleeve includes at least one protrusion forming a profile.

The at least one protrusion of the support sleeve aligns with and releasably engages the at least one groove of the barrier sleeve.

The first set of keys on the mandrel releasably engages the profile of the support sleeve.

The outer surface of the support sleeve includes at least one protrusion forming a profile, wherein the at least one protrusion of the support sleeve aligns with and releasably engages the profile of the barrier sleeve.

Surfaces of the barrier sleeve and the support sleeve that are exposed to the erosional or corrosive fluids comprise a material that is more erosion-resistant or corrosion-resistant than the downhole tool.

The material is a coating.

A method for protecting a downhole tool from degradation in a wellbore has been described. The method may generally include installing a tool into a protection sleeve assembly having a support sleeve disposed in a first position in a barrier sleeve, engaging a first profile having grooves on an interior surface of the barrier sleeve with a first plurality of keys on the mandrel, engaging a second profile having grooves on an interior surface of the support sleeve with a second plurality of keys on the mandrel, running the tool and mandrel with the barrier sleeve and support sleeve into a wellbore, compressing a plurality of collet fingers on the barrier sleeve, engaging a latch coupling with the barrier sleeve, locking the support sleeve in a second position proximate a first end of the barrier sleeve, and removing the downhole tool from the wellbore. Other embodiments of a method for protecting a downhole tool from degradation in a wellbore may generally include installing a tool into a protection sleeve assembly having a support sleeve disposed in a first position in a barrier sleeve, engaging a first profile having grooves on an interior surface of the barrier sleeve with a first plurality of keys on the mandrel, engaging a second profile having grooves on an interior surface of the support sleeve with a second plurality of keys on the mandrel, running the tool and mandrel with the barrier sleeve and support sleeve into a wellbore, compressing a plurality of collet fingers on the barrier sleeve, engaging a latch coupling with the barrier sleeve, locking the support sleeve in a second position proximate a first end of the barrier sleeve, and removing the downhole tool from the wellbore.

For the foregoing embodiments, the method may include any one of the following steps, alone or in combination with each other:

Locking the tool in position relative to the barrier sleeve.

Locking the mandrel in position relative to the support sleeve.

Coupling the tool to the mandrel.

Retrieving the protection sleeve assembly from the wellbore.

Inserting the tool and mandrel in the protection sleeve assembly.

Moving support sleeve from the second position to the first position in the barrier sleeve.

Locking the support sleeve in position relative to the barrier sleeve.

Locking the mandrel in position relative to the tool.

Removing the mandrel, tool, and protection sleeve assembly from the latch coupling.

Inserting the tool and mandrel in the protection sleeve assembly, and moving support sleeve from the second position to the first position in the barrier sleeve.

Locking the support sleeve in position relative to the barrier sleeve, locking the mandrel in position relative to the tool, and removing the mandrel, tool, and protection sleeve assembly from the latch coupling.

While various embodiments have been illustrated in detail, the disclosure is not limited to the embodiments shown. Modification and adaptation of the above embodiments may occur to those skilled in the art. Such modifications and adaptations are in the spirit and scope of the disclosure.

The invention claimed is:

1. An assembly that protects a downhole tool from degradation due to erosional or corrosive fluids, the assembly comprising:

a barrier sleeve having a first end, a second end, an outer surface, and an inner surface forming a passageway; and a support device movably disposed in the barrier sleeve;

wherein the barrier sleeve is disposed between the downhole tool and the erosional or corrosive fluids;

wherein in a first position, the support device releasably engages the barrier sleeve; and wherein additional material that is sacrificially erodible is added to a portion of the inner surface of the barrier sleeve.

2. The assembly of claim 1, wherein an outer surface of the support device includes at least one protrusion forming a profile.

3. The assembly of claim 2, wherein the inner surface of the barrier sleeve includes a profile that releaseably engages the profile of the support device.

4. The assembly of claim 1, wherein the barrier sleeve further comprises at least one annular seal disposed at one of the first end and the second end.

5. The assembly of claim 4, wherein a portion of the barrier sleeve comprises a degradation-resistant material.

6. The assembly of claim 5, wherein the degradation-resistant material is a coating.

7. The assembly of claim 1, wherein the barrier sleeve includes a fluid diverter.

8. The assembly of claim 7, wherein the fluid diverter comprises a sacrificially erodible material.

9. The assembly of claim 1, wherein the assembly is integral with the downhole tool.

10. The assembly of claim 1, wherein the assembly is run into the well separately from the downhole tool.

11. A system for protecting a downhole tool from degradation due to erosional or corrosive fluids, the system comprising:

a tool having a central bore;

a mandrel slidingly disposed through the central bore and having a first and second set of keys;

a barrier sleeve having a first end, a second end, an outer surface, and an inner surface forming a passageway; and a support sleeve having a first end, a second end, an outer surface, and an inner surface forming a passageway, the support sleeve slidingly disposed in the barrier sleeve;

wherein the first and second sets of keys releasably engage a profile on the inner surface of the barrier sleeve; and wherein additional material that is sacrificially erodible is added to a portion of the inner surface of the barrier sleeve.

12. The system of claim 11, wherein the outer surface of the support sleeve includes at least one protrusion forming a profile, wherein the at least one protrusion of the support sleeve aligns with and releasably engages the profile of the barrier sleeve.

13. The system of claim 11, wherein surfaces of the support sleeve that are exposed to the erosional or corrosive fluids comprise a material that is more erosion-resistant or corrosion-resistant than the downhole tool.

14. The system of claim 13, wherein the material is a coating.

15. A method for protecting a downhole tool from degradation in a wellbore, the method comprising:

installing a tool into a protection sleeve assembly having a support sleeve disposed in a first position in a barrier sleeve;

engaging a first profile having grooves on an interior surface of the barrier sleeve with a first plurality of keys on a mandrel;

engaging a second profile having grooves on an interior surface of the support sleeve with a second plurality of keys on the mandrel;

running the tool and mandrel with the barrier sleeve and support sleeve into a wellbore;

compressing a plurality of collet fingers on the barrier sleeve;

engaging a latch coupling with the barrier sleeve;

locking the support sleeve in a second position proximate a first end of the barrier sleeve; and removing the downhole tool from the wellbore.

16. The method of claim 15, further comprising:

locking the tool in position relative to the barrier sleeve.

17. The method of claim 16, further comprising:

retrieving the protection sleeve assembly from the wellbore.

18. The method of claim 17, further comprising:

inserting the tool and mandrel in the protection sleeve assembly; and moving support sleeve from the second position to the first position in the barrier sleeve.

19. The method of claim 17, further comprising:

locking the support sleeve in position relative to the barrier sleeve;

locking the mandrel in position relative to the tool; and removing the mandrel, tool, and protection sleeve assembly from the latch coupling.

* * * * *